US005148763A

United States Patent [19]

White

[11] Patent Number: 5,148,763

[45] Date of Patent: Sep. 22, 1992

[54] KNOCKDOWN BOAT

[75] Inventor: Denny A. White, Huntsville, Mo.

[73] Assignee: White and Cater Partnership, Moberly, Mo.

[21] Appl. No.: 668,936

[22] Filed: Mar. 13, 1991

[51] Int. Cl.[5] ..... B63B 7/04

[52] U.S. Cl. ..... 114/352

[58] Field of Search ..... 114/352, 353, 363, 356, 114/343, 357, 364; 224/328

[56] References Cited

U.S. PATENT DOCUMENTS

| | | | |
|---|---|---|---|
| 3,081,465 | 3/1963 | Billmyer | 114/352 |
| 3,179,961 | 4/1965 | Ward et al. | 114/363 |
| 3,744,071 | 7/1973 | Bossler, Jr. | 114/352 |
| 4,030,152 | 6/1977 | Souza | 114/363 |
| 4,052,761 | 10/1977 | Rilling | 114/352 |

*Primary Examiner*—Edwin L. Swinehart

*Attorney, Agent, or Firm*—Senniger, Powers, Leavitt & Roedel

[57] ABSTRACT

A knockdown boat of this invention has a bow section, an intermediate section and a stern section, each section having a bottom, opposite sides and fore and aft ends, a first motor mount on the aft end of the intermediate section and a second motor mount on the aft end of the stern section. The bow, intermediate and stern sections may be releasably interconnected end to end to form a three-section boat, or the bow and intermediate sections may be releasably interconnected end to end to form a two-section boat. A motor may be mounted on the first motor mount when the boat is used as a two-section boat and on the second motor mount when the boat is used as a three-section boat. The bow, intermediate and stern sections are so dimensioned relative to one another that the bow section is nestable within the intermediate section and the intermediate section is nestable within the stern section when the sections of the boat are disconnected.

17 Claims, 4 Drawing Sheets

KNOCKDOWN BOAT

BACKGROUND OF THE INVENTION

This invention relates generally to boats and, more particularly, to a johnboat of knockdown construction so that it may be readily transported.

Reference may be made to U.S. Pat. Nos. 1,702,872, 1,901,545, 3,381,322, 4,366,769, 4,574,725, 4,794,876 and 4,800,832 for various boat constructions generally relevant to the present invention.

SUMMARY OF THE INVENTION

Among the several objects of this invention may be noted the provision of a boat which is of knockdown design for convenient transport and storage; the provision of such a boat which is easy to assemble and disassemble; the provision of such a boat which is rigid and stable when assembled; the provision of such a boat which is lightweight yet durable; the provision of such a boat which comprises three interconnectable sections, two of which may be interconnected to form a relatively short boat, or three of which may be interconnected to form a longer boat with greater capacity; the provision of such a boat on which a motor may be mounted regardless of whether the boat is used as a two-section boat or as a three-section boat; the provision of such a boat having removable seats containing flotation material; and the provision of such a boat which is of economical construction.

In general, a knockdown boat of this invention has a bow section, an intermediate section and a stern section, each section having a bottom, opposite sides and fore and aft ends, a first motor mount on the aft end of the intermediate section and a second motor on the aft end of the stern section Means is provided for selectively releasably interconnecting (a) the bow, intermediate and stern sections end to end to form a three-section boat, and (b) the bow and intermediate sections end to end to form a two-section boat, a motor being adapted to be mounted on the first motor mount when the boat is used as a two-section boat and on the second motor mount when the boat is used as a three-section boat. The bow, intermediate and stern sections are so dimensioned relative to one another that the bow section is nestable within the intermediate section and the intermediate section is nestable within the stern section when the sections of the boat are disconnected.

Other objects and features will be in part apparent and in part pointed out hereinafter.

BRIEF DESCRIPTION OF THE DRAWINGS

Corresponding parts are designated by corresponding reference numerals throughout the several views of the drawings.

DETAILED DESCRIPTION OF THE PREFERRED EMBODIMENT

Figure 1:
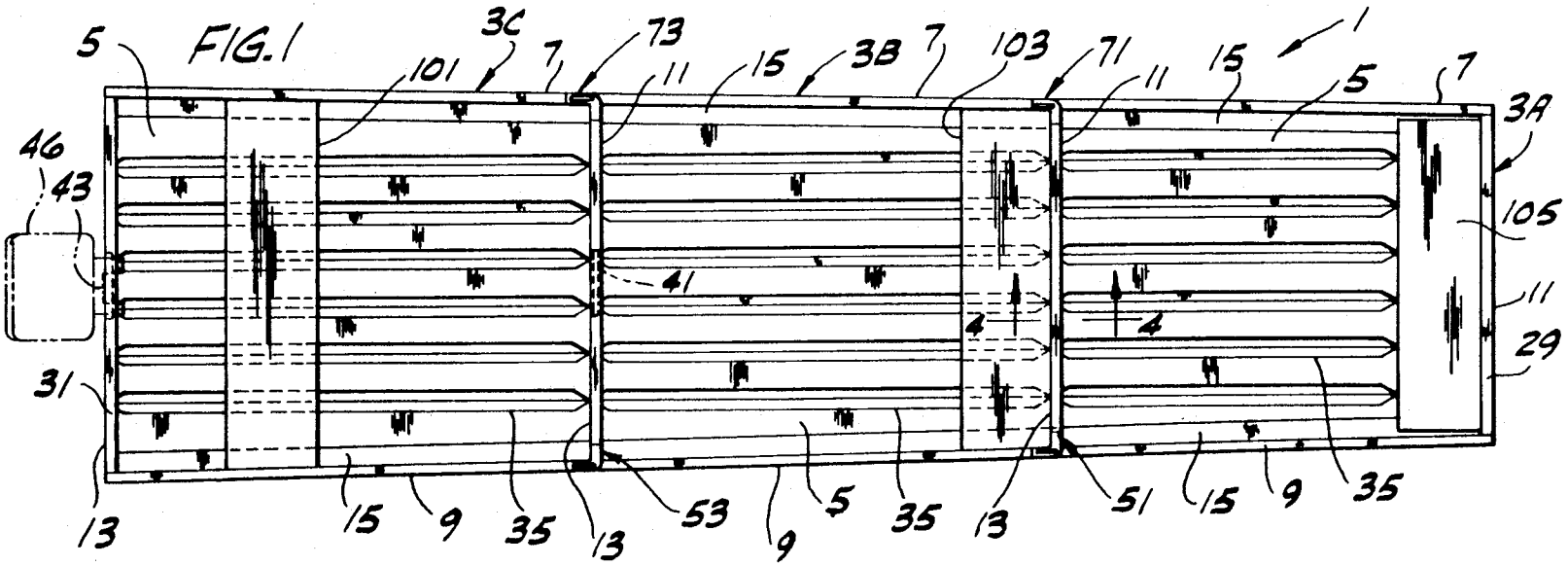
FIG. 1 is a top plan of a boat of this invention comprising bow, intermediate and stern sections.
Figure 2:
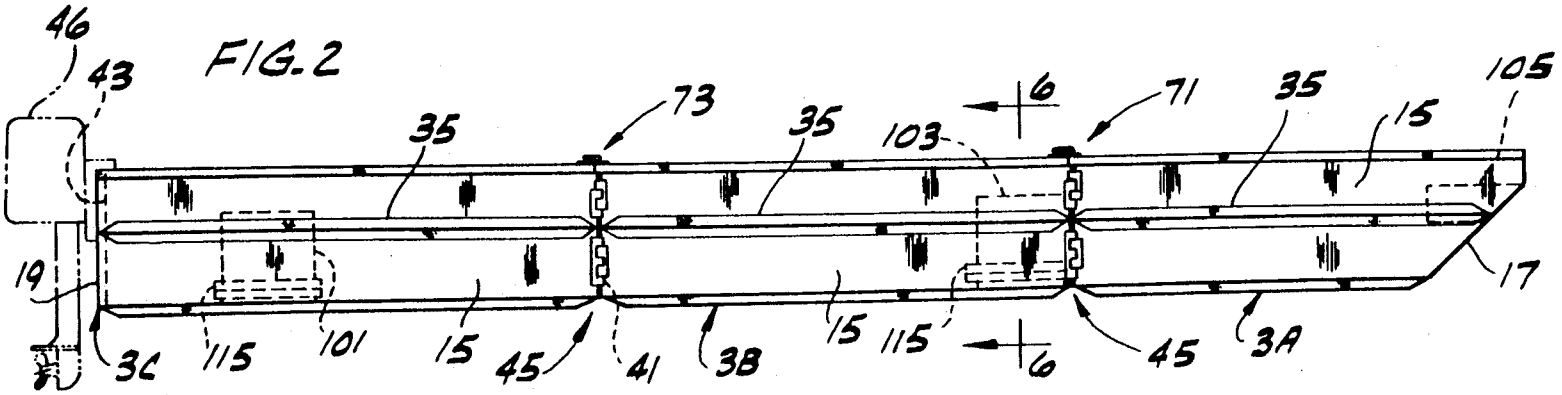
FIG. 2 is a side elevation of the boat.

Referring now to the drawings, and first to FIG. 1, a knockdown boat of the invention is designated in its entirety by the reference numeral 1. The boat has three sections, a bow section. 3A, an intermediate section 3B and a stern section 3C, and each section has a bottom 5, opposite sides 7, 9, and fore and aft ends indicated at 11 and 13, respectively. As illustrated, the boat is a johnboat, the bow and stern sections 3A, 3C having substantially square ends, and the bottom of each section being generally flat. It will be understood, however, that the principles of this invention are applicable to other types of boats.

Figure 6:
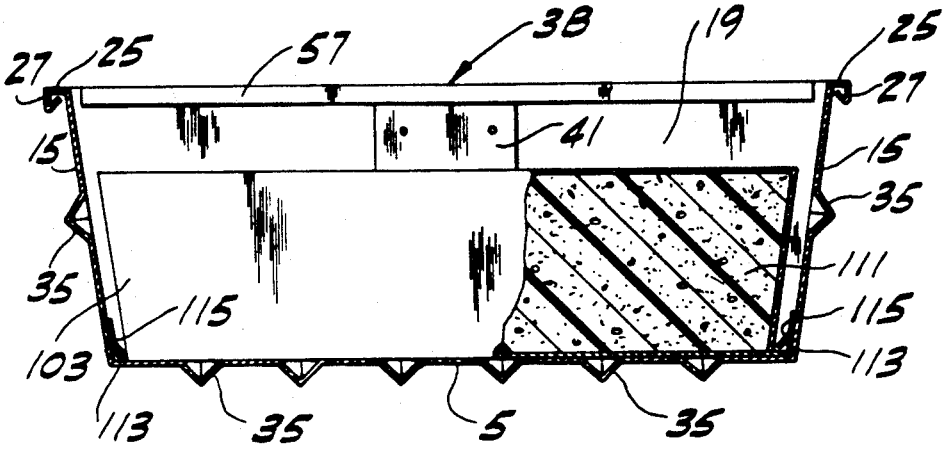
FIG. 6 is an enlarged vertical section taken on line 6—6 of FIG. 2 with parts broken away to show detail.

The boat sections 3A, 3C are fabricated from a lightweight material such as sheet metal (e.g., aluminum) to make the boat more readily portable. Each section is of substantially unitary construction, comprising opposing side walls 15 sloping up and out from the bottom at opposite sides of the boat (FIG. 6), and fore and aft end walls 17, 19 extending up from the bottom 5 at respective fore and aft ends 11, 13 of the section These fore and aft end walls 17, 19 are generally vertical except at the fore end of the bow section 3A, where the wall 21 slopes upwardly and forward from the bottom 5A of the bow section. As best illustrated in FIG. 6, the upper edge of each side wall 15 of each section is formed as an integral flange 25 extending generally horizontally outwardly from the side wall to form a gunnel extending substantially the entire length of the side of the section. The flange 25 forming each gunnel has an inwardly turned lip 27 depending therefrom. The fore wall 17 of the bow section 3A and the aft wall 19 of the stern section 3C have similar flange and lip constructions, as indicated at 29 and 31, respectively, the only difference being that flange 29 extends rearwardly from the fore wall 17 of the bow section and flange 31 extends forwardly from the aft wall 19 of the stern section. The bottom 5 and side walls 15 of each boat section are formed with integral reinforcing ribs 35 running longitudinally of the boat. These ribs are generally V-shaped in cross section and project outwardly away from the interior of the boat, as shown in FIGS. 1 and 6.

Figures 5B, 8, 9:
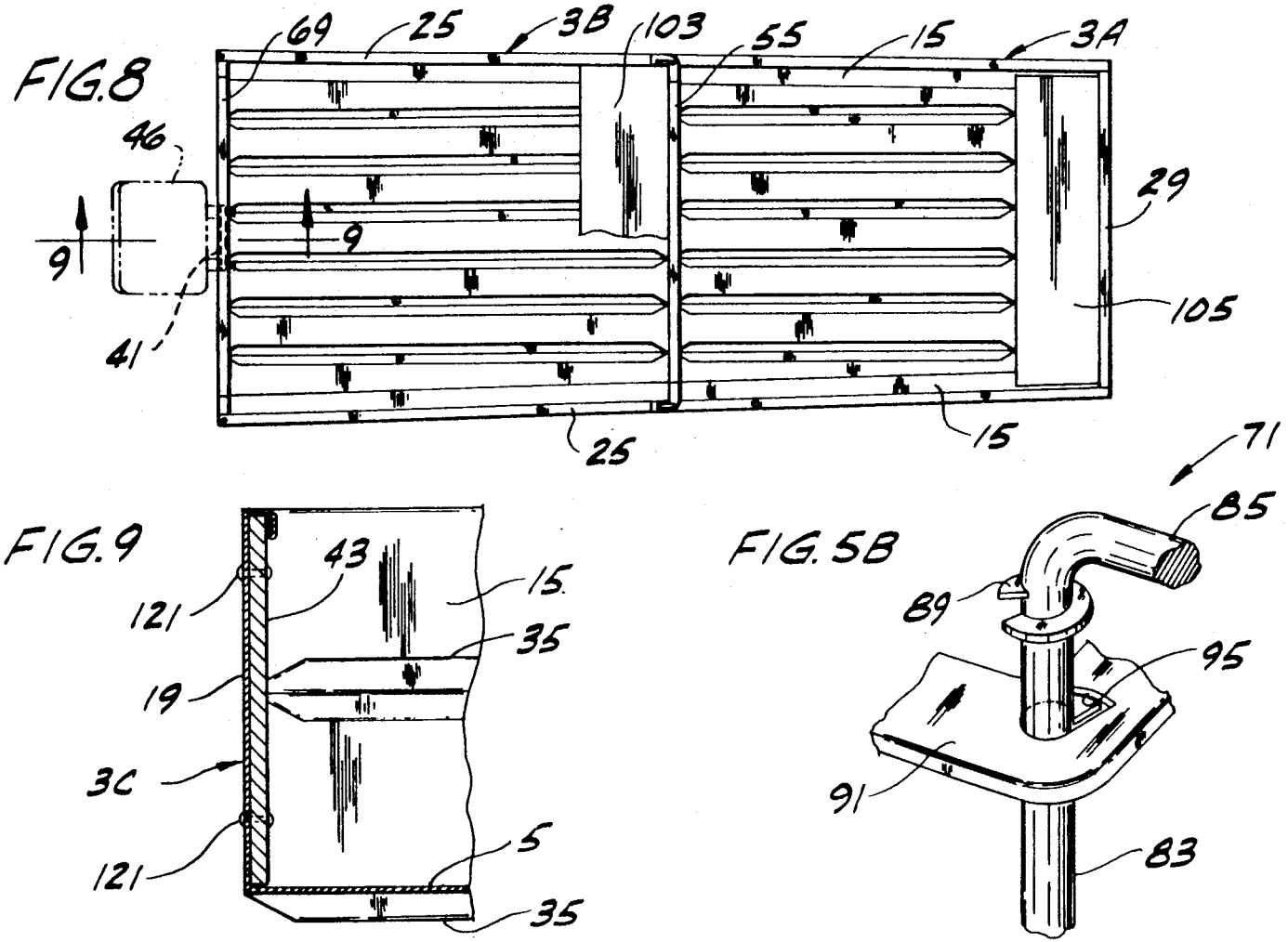
FIG. 5B is an enlarged portion of FIG. 5.
FIG. 8 is a plan view of a two-section boat of this invention.
FIG. 9 is an enlarged vertical section taken in the plane of 9—9 in FIG. 8.

In accordance with this invention, the boat further comprises a first motor mount 41 on the aft end of the intermediate section 3B and a second motor mount 43 on the aft end of the stern section, and means generally indicated at 45 for selectively interconnecting the bow, intermediate and stern sections 3A, 3B, 3C end to end to form a three-section boat (see FIG. 1) and for releasably interconnecting the bow and intermediate sections end to end to form a two-section boat (FIG. 8). A motor 46 is adapted to be mounted on the first motor mount 41 when the boat is used as a two-section boat and on the second motor 43 mount when the boat is used as a three-section boat.

Figure 4:
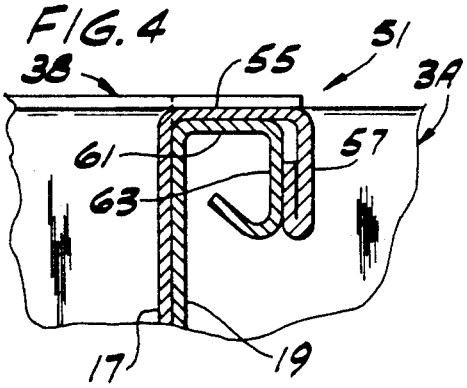
FIG. 4 is an enlarged sectional view on line 4—4 of FIG. 1 showing interengaged flanges of two connected boat sections.
Figure 3:
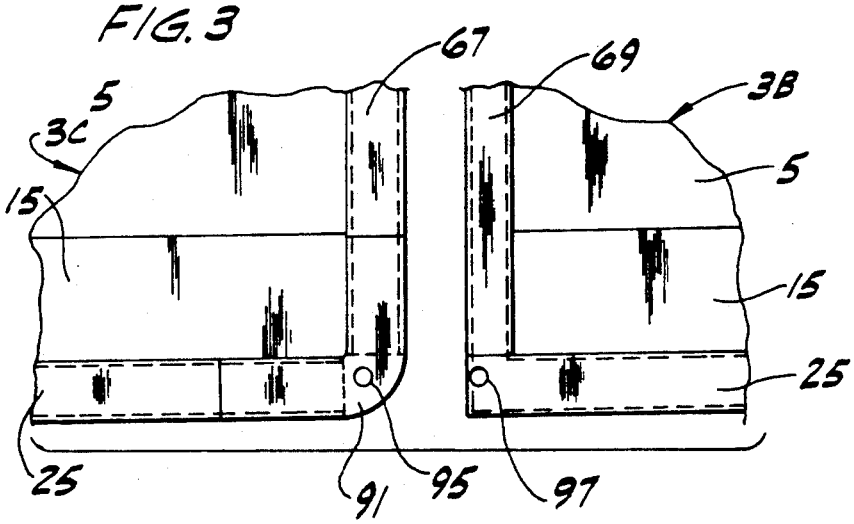
FIG. 3 is a top plan of corner portions of two boat sections to the interconnected.

More particularly, means 45 comprises first interengageable flange means 51 at the aft end of the bow section 3A and the fore end of the intermediate section 3B for connecting the bow and intermediate sections, and second interengageable flange means 53 at the aft end of the intermediate section and the fore end of the stern section for connecting the intermediate and stern sections. As shown in FIG. 4, first flange means 51 comprises a first flange 55 extending forward from a top edge of the fore wall 17 of the intermediate section 3B and having a forward edge margin bent to form a downwardly extending first lip 57, the lower end of the lip being bent back up in vertical direction for reinforcement, and a second flange 61 extending forward from a top edge of the aft wall 19 of the bow section 3A and having an aft edge margin bent to form a downwardly extending lip 63, the lower end of which is bent forwardly and upwardly as shown. When interengaged with the second flange 61, the first flange 55 is adapted to overlay the second flange with the first lip 57 forward of the second lip 63 and substantially contiguous therewith, as shown. The flanges 55, 61 are so formed and dimensioned that when they are interengaged, the aft end wall 19 of the bow section 3A is in contact with the fore end wall 17 of the intermediate section 3B to form a rigid structure. Each of the first and second flanges 55, 61 is integrally formed with its respective boat section and is a unitary flange extending substantially the full width of respective bow and intermediate boat sections. Second flange means 53 for releasably connecting the intermediate and stern sections 3B, 3C of the boat comprises a pair of flanges 67, 69 essentially identical to the first and second flanges 55, 61 described above (see FIG. 3).

Interconnecting means 45 further comprises first locking means generally designated 71 for locking the bow and intermediate sections 3A, 3B together when the flanges 55, 61 of the first flange means 51 are interengaged, and second locking means generally designated 73 for locking the intermediate and stern sections 3B, 3C together when the flanges 67, 69 of the second flange means 53 are interengaged. The first and second locking means 71, 73 are identical in design, so only the first (71) will be described in detail.

Figure 5:
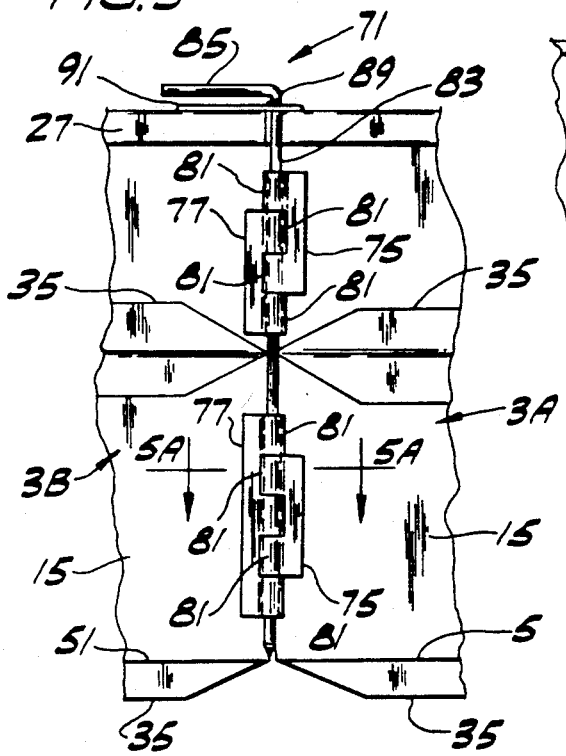
FIG. 5 is an enlarged elevational view showing a locking means of this invention for locking two boat sections together.
Figure 5A:
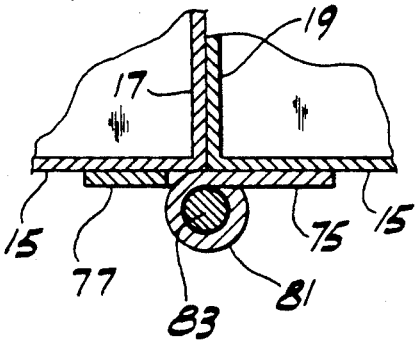
FIG. 5A is an enlarged horizontal section on line 5A—5A of FIG. 5.

Specifically, the first locking means 71 comprises a first set of locking members, each designated 75, at the aft end of the bow section 3A on opposite sides of the bow section, and a second set of locking members, each designated 77, at the fore end of the intermediate section 3B on opposite sides of the intermediate section. The locking members 75 of the first set are designed to interfit or mate with the locking members 77 of the second set when the two flanges 55, 61 of flange means 51 are interengaged. This interfit is illustrated in FIG. 5, which shows a pair of vertically spaced locking members 75 attached to the aft end of the bow section 3A interfitting with a pair of vertically spaced locking members 77 attached to the fore end of the intermediate section 3B (the locking members 75, 77 at the opposite side of the boat are adapted to interfit in like fashion). Each locking member 75, 77 is formed with two vertically spaced but aligned tubular portions 81 (FIGS. 5 and 5A). The tubular portions 81 of the locking members 75 on one boat section (3A) interdigitate with the tubular portions 81 of the locking members 77 on the other boat section (3B) so that the tubular portions of the locking members on the two boat sections are vertically aligned for insertion of a locking pin 83 therethrough. Each locking member 75, 77 may be fabricated from metal, for example, and suitably attached (e.g., welded) to a respective side wall 15 of the boat. With the locking pins 83 in place (one at each side of the boat) and the flanges 55, 61 of the first flange means 51 interengaged, the bow and intermediate sections of the boat are rigidly secured together to form a single rigid structure.

As noted above, the second locking means 73 is identical to the first locking means 71 and functions to lock the intermediate and stern sections 3B, 3C together as a rigid unit when the flanges 67, 69 of flange means 53 are interengaged.

Each locking pin 83 comprises a straight metal rod having an upper end bent at right angles to the rod to form a handle 85. After the pin is inserted through the interdigitated tubular portions of the locking members as shown in FIG. 5, the handle may be turned to lock the pin in position for preventing unintentional withdrawal of the pin from the position shown. This may be accomplished by means comprising a helical or screw member 89 affixed to the pin 83 for engagement with an L-shaped bracket 91 mounted on the side and aft flanges of the respective boat section, the arrangement being such that when the pin is turned, a portion of the screw member 89 moves below the bracket 91 so that the pin cannot be lifted until is it is rotated back to a position in which the screw member is entirely above the bracket (see FIG. 5B). The bracket 91 has a hole 95 therein through which the pin 83 is inserted. This hole 95 registers with a hole 97 in the side flange 25 of the adjacent boat section when the two sections are interengaged (see FIG. 3).

Figure 6A:
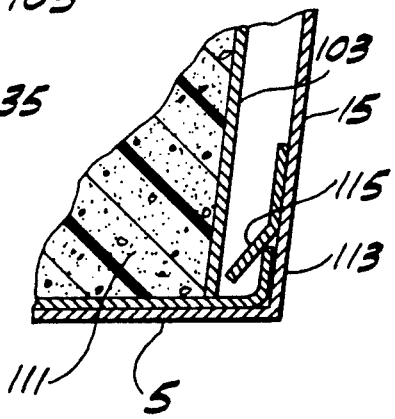
FIG. 6A is an enlarged portion of FIG. 6.

The boat is provided with three seat structures, a stern seat structure 101 in the stern section 3C of the boat, an intermediate seat structure 103 in the intermediate section 3B of the boat, and a bow seat structure 105 in the bow section 3A of the boat. Each of the stern and intermediate seat structures 101, 103 comprises an elongate hollow structure generally rectangular in transverse section and having opposite ends, and each contains a suitable flotation material 111 (e.g., a suitable foamed plastic). The stern and intermediate seat structures are preferably removable from the boat a longitudinal direction with respect to the boat, each having sliders 113 at opposite ends of the structure slidable in guideways formed by guide members 115 attached to opposite side walls of respective boat sections immediately above the floor of the boat. As shown in FIGS. 6 and 6A, the sliders project endwise from opposite ends of each seat structure 101, 103 and have upturned edges slidably receivable in downwardly opening guideways defined by guide members 115 consisting of generally horizontal strips affixed to the side walls 15 of the boat and having lower edge margins spaced from the side walls. The arrangement is such that the intermediate seat structure 103 is slidable to a position adjacent the fore end wall 17 of the intermediate section 3B, and the stern seat structure 101 is slidable to a position toward the aft end wall 19 of the stern section 3C (but spaced from the end wall to allow a motor to be mounted on motor mount 43). The friction fit of the sliders 113 in respective guideways is sufficiently loose to enable the seat structures 101, 103 to be readily installed in the boat and removed from the boat, yet sufficiently tight to hold the seat structures in place after they have been positioned. The bow seat structure 105 is preferably permanently secured in its position immediately adjacent the fore end wall 17 of the bow section 3A of the boat.

Figure 7:
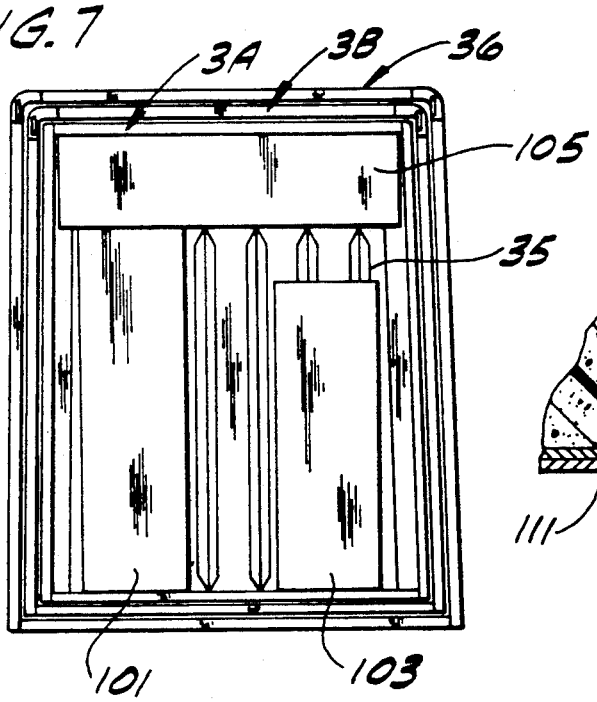
FIG. 7 is a plan view showing the bow, intermediate and stern sections of the boat disconnected and nested one inside the other.

As shown in FIG. 7, the bow, intermediate and stern sections 3A, 3B, 3C of the boat are so dimensioned relative to one another that the bow section is nestable within the intermediate section and the intermediate section is nestable within the stern section when the three sections are disconnected. Moreover, the stern and intermediate seat structures 101, 103, when removed from their respective boat sections, are sized to fit in the bow section 3A as shown, that is, extending in fore-to-aft direction between the bow seat structure 105 and the aft end wall 19 of the bow section, the result being that the entire boat can be knocked down into a very compact and lightweight unit for easy handling, transportation and storage.

Each of the motor mounts 41, 43 comprises a generally rectangular panel of suitable material (e.g., wood). Motor mount 43 is attached, as by fasteners 121, to the aft end wall 19 of the stern section 3C of the boat, and is used when the boat is being used as a three-section boat (i.e., when the bow, intermediate and stern sections are all connected for maximum capacity). Motor mount 41 is attached in similar fashion to the aft end wall of the intermediate section 3C of the boat, and is used when the boat is being used as a two-section boat (i.e., when only the intermediate and bow sections are connected).

It will be observed from the above description that a knockdown boat of this invention can readily be converted from its nested configuration as shown in FIG. 7 in which the boat occupies only a minimum of space for easy transport, handling and storage, to its functional configuration in which two or more of the sections are interconnected for use of the boat as a two-section boat are as a three-section boat. This is accomplished merely by interengaging the flanges (55, 61 and 67, 69) of respective sections of the boat, moving the sections to bring the locking members 75, 77 into interfitting relation, and inserting the locking pins 83 in place, at which time the boat sections form a very stiff, rigid structure for maximum stability in the water, either with or without a motor. If desired, a motor can be mounted on the boat regardless of whether the boat is used as a two-section boat or as a three-section boat. It will be understood that more than three boat sections may be used without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A knockdown boat comprising a bow section, an intermediate section and a stern section, each section having a bottom, opposite sides and fore and aft ends, a first motor mount for mounting a motor on the aft end of the intermediate section and a second motor mount for mounting a motor on the aft end of the stern section, means for selectively releasably interconnecting the bow, intermediate and stern sections end to end to form a three-section boat and for releasably interconnecting the bow and intermediate sections end to end to form a two-section boat, the motor being adapted to be mounted on the first motor mount when the boat is used as a two-section boat and on the second motor mount when the boat is used as a three-section boat, said bow, intermediate and stern sections being so dimensioned relative to one another that the bow section is nestable within the intermediate section and the intermediate section is nestable within the stern section when the sections of the boat are disconnected.

2. A boat as set forth in claim 1 wherein said bow, intermediate and stern sections are fabricated from lightweight material, each section being of substantially unitary construction.

3. A boat as set forth in claim 2 wherein said bow section has an aft end wall extending up from the bottom of the bow section and wherein each of said intermediate and stern sections has fore and aft end walls extending up from the bottom of the respective section, said means for selectively releasably interconnecting sections of the boat comprises first interengageable flange means bent from top edges of the aft end wall of the bow section and the fore end wall of the intermediate section for connecting the bow and intermediate sections, second interengageable flange means bent from top edges of the aft end wall of the intermediate section and the fore end wall of the stern section for connecting the intermediate and stern sections, first locking means for locking the bow and intermediate sections together when said first flange means is interengaged, and second locking means for locking the intermediate and stern sections together when said second flange means is interengaged, said first and second flange means combining with said first and second locking means for rigidly connecting the boat sections together to form a single rigid structure.

4. A boat as set forth in claim 3 further comprising a stern seat structure adapted to be removably installed in the stern section and an intermediate seat structure adapted to be removably installed in the intermediate section, each seat structure containing flotation material, and sliders on each of said stern and intermediate seat structures slidable in guideways on respective sections of the boat extending longitudinally with respect to the boat.

5. A boat as set forth in claim 4 wherein each of said stern and intermediate seat structures is an elongate hollow structure generally rectangular in transverse section and having opposite ends, said sliders being located at opposite ends of each seat structure and said guideways being located adjacent at opposite side walls of a respective stern or intermediate section.

6. A boat as set forth in claim 5 wherein said intermediate seat structure is slidable to a position adjacent the fore end of the intermediate section and said stern seat structure is slidable to a position toward the aft end of the stern section.

7. A boat as set forth in claim 4 further comprising a bow seat structure at the fore end of the bow section of the boat, said stern and intermediate seat structures, when removed from their respective boat sections, being sized to fit in said bow section extending in fore-to-aft direction between said bow seat structure and the aft end of the bow section.

8. A boat as set forth in claim 4 wherein the bottom and sides of each of the bow, intermediate and stern sections is formed with integral reinforcing ribs.

9. A boat as set forth in claim 8 wherein said reinforcing ribs are generally V-shaped in cross section and project outwardly away from the interior of the boat.

10. A boat as set forth in claim 9 wherein each of the bow, intermediate and stern sections has opposing side walls extending up from the bottom of the respective section, the upper edge of each side wall of each section being formed with an integral flange extending generally horizontally outwardly from the side wall to form a gunnel extending substantially the entire length of the side of the section.

11. A boat as set forth in claim 10 wherein the flange forming each of said gunnels has an inwardly turned lip depending therefrom.

12. A boat as set forth in claim 2 wherein each of said first and second motor mounts comprises a generally rectangular panel attached to the aft end of a respective boat section.

13. A knockdown boat comprising a bow section, an intermediate section and a stern section, each section being fabricated from lightweight material and of substantially unitary construction, each section having a bottom, opposite sides and fore and aft ends, a first motor mount on the aft end of the intermediate section and a second motor mount on the aft end of the stern section, means for selectively releasably interconnecting the bow, intermediate and stern sections end to end to form a three-section boat and for releasably interconnecting the bow and intermediate sections end to end to form a two-section boat, a motor being adapted to be mounted on the first motor mount when the boat is used as a two-section boat and on the second motor mount when the boat is used as a three-section boat, said bow, intermediate and stern sections being so dimensioned relative to one another that the bow section is nestable within the intermediate section and the intermediate section is nestable within the stern section when the sections of the boat are disconnected;

said means for selectively releasably interconnecting sections of the boat comprises first interengageable flange means at the aft end of the bow section and the fore end of the intermediate section for connecting the bow and intermediate sections, second interengageable flange means on the aft end of the intermediate section and the fore end of the stern section for connecting the intermediate and stern sections, first locking means for locking the bow and intermediate sections together when said first flange means is interengaged, and second locking means for locking the intermediate and stern sections together when said second flange means is interengaged, said first and second flange means combining with said first and second locking means for rigidly connecting the boat sections together to form a single rigid structure;

said bow section having an aft end wall extending up from the bottom of the bow section and said intermediate section having fore and aft end walls extending up from the bottom of the intermediate section, said first interengageable flange means comprising a first flange extending forwardly from a top edge of the fore wall of the intermediate section and having a fore edge margin bent to form a downwardly extending first lip, and a second flange extending forwardly from a top edge of the aft wall of the bow section and having a fore edge margin bent to form a downwardly extending second lip, the first flange, when interengaged with the second flange, being adapted to overly the second flange with said first lip forward of said second lip and substantially contiguous therewith, said flanges being so formed and dimensioned that when they are interengaged, the aft end wall of the bow sections is in contact with the fore end wall of the intermediate section.

14. A boat as set forth in claim 13 wherein each of said first and second flanges comprises a unitary flange extending substantially the full width of respective bow and intermediate sections of the boat.

15. A boat as set forth in claim 13 wherein said first locking means comprises a first set of locking members at the aft end of the bow section on opposite sides of the bow section, and a second set of locking members at the fore end of the intermediate section on opposite sides of the intermediate section adjacent the first set of locking members, said first set being adapted to interfit with the locking members of said second set when said first set of flanges are interengaged, and a pair of locking pins for releasably locking said first and second sets of locking members in interfitting relation.

16. A boat as set forth in claim 15 wherein the locking members of said first and second sets of locking members have tubular portions, the tubular portions of the locking members of the first set being adapted to interdigitate with the tubular portions of the locking members of the second set with the tubular portions generally in vertical alignment for insertion of said locking pins therethrough.

17. A boat as set forth in claim 16 further comprising means for preventing unintentional withdrawal of each pin from its respective aligned tubular portions of the locking members.

* * * * *